US005628351A

United States Patent [19]

Ramsey, Jr. et al.

[11] Patent Number: 5,628,351

[45] Date of Patent: May 13, 1997

[54] METHOD FOR AUTOMATED REFUELLING

[75] Inventors: William D. Ramsey, Jr., Kingwood, Tex.; David I. Musil, Port Coquitlam, Canada; Owen R. Williams, New Westminster, Canada; Andrew E. Loen, Port Alberni, Canada; Al West, Burnaby, Canada

[73] Assignee: Shell Oil Company, Houston, Tex.

[21] Appl. No.: 461,280

[22] Filed: Jun. 5, 1995

[51] Int. Cl.[6] ..... B65B 1/04

[52] U.S. Cl. ..... 141/98; 141/94; 141/392; 137/234.6

[58] Field of Search ..... 141/1, 59, 98, 141/94, 114, 231, 312, 368, 382, 388, 392, 387; 186/36; 137/234.6; 340/450.2, 471, 941, 928, 933, 937, 942, 943

[56] References Cited

U.S. PATENT DOCUMENTS

| | | | |
|---|---|---|---|
| 3,527,268 | 9/1970 | Ginsburgh | 141/98 |
| 3,642,036 | 2/1972 | Ginsburgh et al. | 141/94 |
| 4,263,945 | 4/1981 | Van Ness | 141/98 |

(List continued on next page.)

FOREIGN PATENT DOCUMENTS

| | | |
|---|---|---|
| 418744A2 | 3/1991 | European Pat. Off. . |
| 4242243A1 | 6/1994 | Germany . |
| WO94/03391 | 2/1994 | WIPO . |
| WO95/32919 | 12/1995 | WIPO . |

OTHER PUBLICATIONS

Serapid chain sales literature, Serapid, France, 2 pages (no available date).

"Lawrence Livermore Laboratory: Hoping to Make Highways Safer," *Technology Transfer Business,* Fall 1994, 1 page.

Dawn Stover, "Radar on a Chip, 101 Uses in Your Life" *Popular Science,* Mar. 1995, 6 pages.

Cheryl Ajluni, "Low–Cost Wideband Spread–Spectrum Device Promises to Revolutionize Radar Proximity Sensors," *Electronic Design,* Jul. 25, 1994, 2 pages.

*Technology,* "Pumping Gas in the Year 2000," by Klaus–Ulrich Blumenstock and Konstantin Tschovikov, 3 pp. (no date available).

*Primary Examiner*—Henry J. Recla
*Assistant Examiner*—Steven O. Douglas
*Attorney, Agent, or Firm*—Del S. Christensen

[57] ABSTRACT

A method for automated refuelling is provided, the method comprising the steps of: providing the vehicle with a radio frequency transponder effective to communicate information sufficient to establish a position of a fuel inlet on the vehicle; receiving the communicated information at location where the vehicle is to be refuelled when the vehicle is located at the location where the vehicle is to be refuelled; when the vehicle is located at the location where the vehicle is to be refuelled, determining the position and orientation of the vehicle within the location; determining from the position and orientation of the vehicle and the communicated information, an expected location of the fuel inlet; after the vehicle is driven to an automated refuelling apparatus, initiating refuelling by moving a fuel dispenser to adjacent the expected location of the fuel inlet; providing a sensor on the fuel dispenser to determine the location of the fuel inlet relative to the fuel dispenser; repositioning the fuel dispenser based on a signal from the sensor on the fuel dispenser to a position from which the vehicle can be refuelled from the dispenser; and refuelling the vehicle from the repositioned fuel dispenser. This method, and the apparatus useful in the practice of this method, do not require accurate initial positioning of the vehicle by the driver, or extensive modifications to the vehicle. The refuelling operation is not commenced until engine operation of the vehicle is discontinued, and the refuelling operation can be discontinued when the vehicle engine is restarted.

12 Claims, 1 Drawing Sheet

U.S. PATENT DOCUMENTS

| | | | |
|---|---|---|---|
| 4,490,798 | 12/1984 | Franks et al. | 364/550 |
| 4,881,581 | 11/1989 | Hollerback | 141/113 |
| 4,934,419 | 6/1990 | Lamont et al. | 141/98 |
| 5,072,380 | 12/1991 | Randelman et al. | 364/406 |
| 5,204,819 | 4/1993 | Ryan | 364/465 |
| 5,238,034 | 8/1993 | Corfitsen | 141/94 |
| 5,383,500 | 1/1995 | Dwars et al. | 141/98 |
| 5,404,923 | 4/1995 | Yamamoto et al. | 141/279 |

METHOD FOR AUTOMATED REFUELLING

FIELD OF INVENTION

This invention relates to a method for automated refuelling of vehicles.

BACKGROUND TO THE INVENTION

Numerous apparatuses have been proposed for automatic refuelling of vehicles, but none have been commercially applied at retail gasoline outlets. This is most probably because of the expense and complexity of the systems. Such an automated refuelling system must be relatively simple, and must be assembled from relatively inexpensive components to be economically competitive with customers ability to refuel automobiles manually, or an attendant. Additionally, minimal modifications to vehicles to be refuelled is necessary.

U.S. Pat. No. 3,527,268 suggests a automated refuelling system that includes a movable head having three functional arms, an arm to open a gas cap cover lid, an arm to remove a gas cap, and a fuel fill nozzle that is inserted into the fuel inlet. The movable head is located near the fuel inlet of a vehicle by a gantry that positions the movable head in a horizontal two-dimension plane over an appropriate position. A vertical arm supporting the movable head then extends downward from the gantry to position the movable head at an appropriate elevation. Primary positioning of the vehicle is proposed to be by physical means such as guide rails or trenches for a front tire of the vehicle. It is suggested that a fully automatic identification means could be used to identify the make, model, year and body style of a vehicle for the purpose of locating the fuel inlet. It is suggested that a card containing this information could be located in a window of the vehicle, and the card could be read photoelectrically. Alternatively, it is suggested that one, or preferably two, photoelectric silhouettes of the automobile could be generated and used to determine the make, model and year of the vehicle. The vehicle make, model, year and body style could also be provided by the driver of the vehicle via an input panel. An emergency stop button is also provided to permit the driver to discontinue the refuelling operation. The system and method of this patent requires the driver to position the vehicle properly for the refuelling arm to approach the vehicle accurately enough to refuel the vehicle, requires the driver to manually discontinue refuelling if the driver desires to depart before the refuelling process is completed, and in a preferred embodiment, requires that the driver correctly input the vehicle make, model, year and body style. Such reliance on the driver to correctly operate an automated refuelling system is not desirable. A more automated system with less reliance on a driver to perform such tasks correctly is desired.

German Patent Application 42 42 243 A1, PCT Patent Application No. IT93/00017, and U.S. Pat. Nos. 3,642,036 and 5,238,034 also suggest refuelling robots that could not reach fuel inlets for vehicles with fuel inlets in the rear or the side opposite to the position of the robot.

It is therefore an object of the present invention to provide an apparatus and method for automated refuelling of vehicles that is relatively simple and inexpensive, and wherein a precise initial positioning by a driver of a vehicle to be refuelled is not required, and wherein driver input for determining the position of the fuel inlet is not required. It is a further object to provide such a method and apparatus wherein significant modifications to the vehicle to be refuelled are not required.

SUMMARY OF THE INVENTION

These and other objects of the present invention are achieved by a method for automatic refuelling of a vehicle comprising the steps of: providing the vehicle with a radio frequency transponder effective to communicate information sufficient to establish a position of the fuel inlet on the vehicle; receiving the communicated information at location where the vehicle is to be refuelled when the vehicle is located at the location where the vehicle is to be refuelled; when the vehicle is located at the location where the vehicle is to be refuelled, determining the position and orientation of the vehicle within the location; determining from the position and orientation of the vehicle and the communicated information, an expected location of the fuel inlet; moving a fuel dispenser to adjacent the determined expected location of the fuel inlet; providing a sensor on the fuel dispenser to determine the location of the fuel inlet relative to the fuel dispenser; repositioning the fuel dispenser based on a signal from the sensor on the fuel dispenser to a position from which the vehicle can be refuelled from the dispenser; and refuelling the vehicle from the repositioned fuel dispenser.

The method of the present invention includes the use of a radio-frequency transponder to identify sufficient information about the vehicle to determine the location of the fuel inlet, sensors to determine the location of the vehicle within a refuelling bay, and a sensor on a fuel dispenser to determine a more precise position of the fuel inlet. In a preferred embodiment, the information communicated from the radio-frequency transponder is also sufficient to provide billing or payment for the refuelling operation.

Initial positioning of the vehicle may be determined by a plurality of, and preferably at least three, range-finding type sensors, such as acoustic, laser, or radar range finding sensors, radar imaging, magnetic flux sensors, pressure pads in the pavement, or by a visual matching of outlines of the vehicle by data from a camera.

Engine operation, or lack thereof, in a preferred embodiment of the present invention, is determined and used as a criteria for initiation of or continuation of the refuelling method. Engine operation can be determined, for example, by an antenna loop placed within the surface below the location of the vehicle to be refuelled, the antenna effective to sense normal operation of an vehicle's alternator. Operation of an alternator is differentiated from operation of any electric motor such as fan motor or a motor to raise or lower headlights or a radio antenna by the frequency and strength of the oscillating magnetic field created by operation of the alternator. Alternatively, operation of a vehicle's engine may be determined by a radio receiver that detects fields generated by the ignition system of the vehicle.

The sensor to determine the position of the refuelling head relative to the fuel inlet of the vehicle is preferably either a visual recognition system, or a magnetic flux sensor with a magnet located near the fuel inlet. Alternatively, a transponder could be located near the location of the fuel inlet. This transponder could be the same transponder that is used to transmit information on the location of the fuel inlet on the vehicle, or a different transponder. A more precise location of the fuel inlet is generally required because the fuel inlet position can vary on a vehicle due to variations in tire inflation, vehicle load, air-shock inflation, damage history, or inconsistencies in the manufacture of each make and model of vehicle.

This method, and the apparatus useful in the practice of this method, do not require accurate initial positioning of the vehicle by the driver, or extensive modifications to the vehicle. Preferably, the refuelling operation is not commenced until engine operation of the vehicle is discontinued, and the refuelling operation is preferably discontinued when the vehicle engine is restarted.

DETAILED DESCRIPTION OF THE INVENTION

Figure 1:
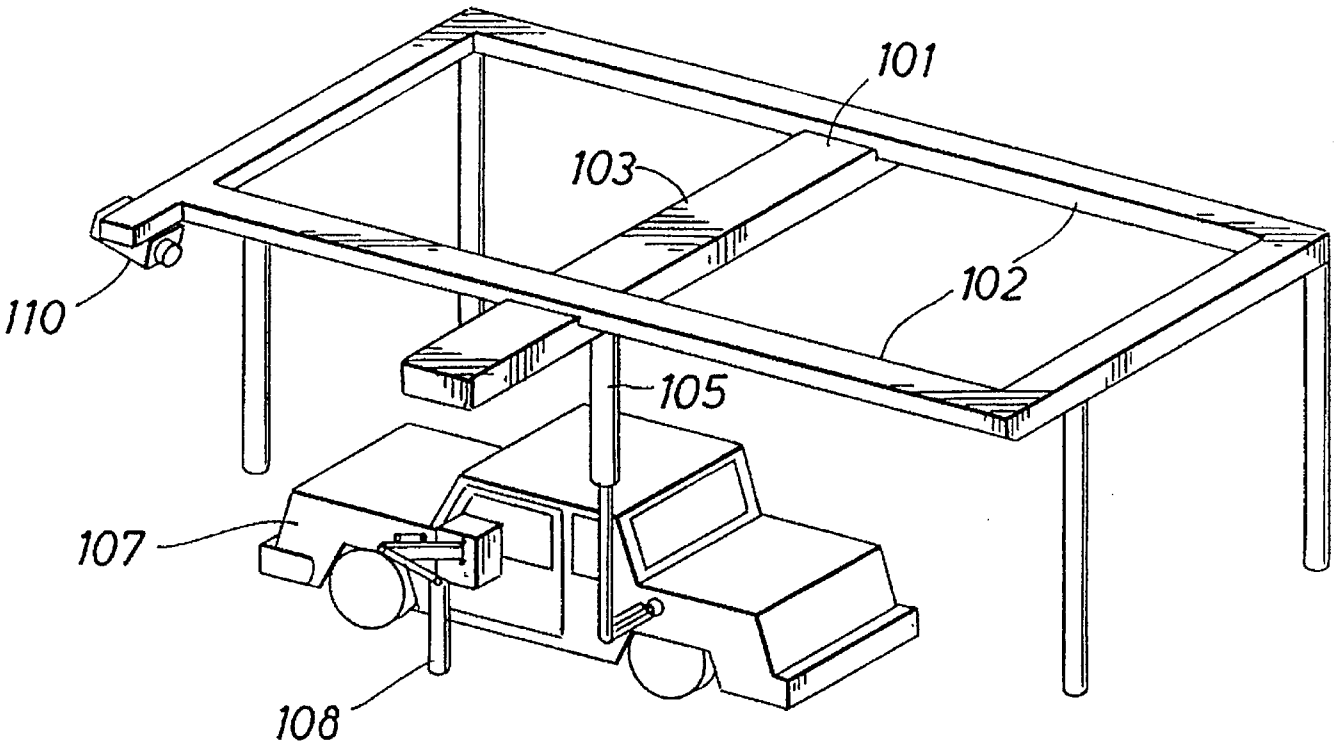
FIG. 1 shows a perspective view of the general arrangement of a preferred refuelling system of the present invention.

Referring now to FIG. 1, the general arrangement of components of a vehicle refuelling system according to a preferred embodiment of the present invention is shown. An overhead gantry 101 with a set of longitudinal supports 102 and a cross member 103 is shown. This gantry can move a nozzle manipulator 105 to position the refuelling nozzle on either side, or the rear of a vehicle, according to the location of the fuel inlet.

The location of the fuel inlet can be determined from data obtained from a transponder card (not shown) preferably placed on a windshield of a vehicle to be refueled 107. The transponder card can be one of many commercially available, preferably passive, transponder systems. For example, Amtech, located in Dallas, Tex., offers a transponder card system called "INTELLA TAG" which cards sell for about twenty five U.S. dollars. This transponder card system has a data capacity of 1408 bits, and operate on a radio frequency of 924 Mhz. Motorola Indala, of San Jose, Calif., produces another passive RF transponder system. Motorola's system has a 64 bit capacity that is readable from about two feet. Cards cost about three U.S. dollars, and acceptable readers can be purchased for about 630 U.S. dollars. TIRIS, of Austin, Tex., also offers acceptable systems. Active transponders are also available that operate on watch-type batteries and have significantly greater range. Although active transponders are more expensive, they could be acceptable in the practice of the present invention.

Other means of determining the vehicle type and/or identification are inferior to the radio-frequency transponders of the present invention. For example, an optical bar code could be provided on a sticker on a window, bumper or fender, but such an optical system would be defeated if it were masked with dirt. Magnetic strips could also be provided to transmit this information, but the range from which a magnetic strip could be read is limited. It is also possible that a vision and recognition system could be used to identify the make and model of the vehicle.

The transponder system of the present invention provides vehicle information to the automated refuelling system thereby allowing the system to know the location of the fuel inlet on the vehicle. Credit card information could also be transmitted automatically, but alternatively, a customer interface 108 including a credit card reader (not shown) may be included. The use of the customer interface and credit card reader ensures that the refuelling operation is intentionally initiated by the customer and provides a confirmation that the authorized customer is receiving the refuelling service.

The positioning of the fuel supply nozzle adjacent to the fuel inlet is preferably accomplished by a position sensor located on the fuel supply nozzle. The position sensor determines the position of the fuel supply nozzle with relationship to the fuel supply inlet. This position sensor may be, for example, a magnetic flux determination, with a magnet located on either the fuel inlet, fuel cap or on the hinged lid over the fuel inlet, or a vision system with a visual pick-up located on the fuel supply nozzle with information from the visual pick-up processed by software capable of recognizing the outline of the fuel hinged cover or fuel cap, and most preferably, also the position of the hinged cover about its hinged axis.

If a vision system is utilized to identify the position of the fuel inlet, the vision system may also be used to identify the location of the fuel cap after the hinged cover is opened, and possibly to identify the license plate number of the vehicle, for example, as a security check.

The customer interface is preferably automatically movable in the vertical direction and laterally toward the vehicle so that the interface is easily accessible from the driver's side window without the driver having to open the vehicle door. Movement of the customer interface could be initiated by the automated refuelling system upon a vehicle coming to a stop in a position to be refuelled, and preferably, after a confirmation that the engine of the vehicle has been shutdown. Information obtained from the transponder system could dictate the best vertical height for the customer interface for the particular vehicle. The automated refuelling system also is preferably provided with a means to determine the location of the vehicle relative to the system, and this information can be used to determine the extent of movement toward the vehicle for best placement of the customer interface. The customer interface, in a preferred embodiment, does not move laterally along the axis of the vehicle because the driver is encouraged to pull up to the interface with the interface juxtapose to the driver's side window. This provides that the vehicle will be within reach of the automated refuelling system.

A preferred customer interface is disclosed in U.S. patent application Ser. No. 08/461,275, filed on Jun. 5, 1996, incorporated herein by reference.

A simple ultrasonic range determination can alternatively be provided to determine the location of the vehicle relative to the customer interface. A preferred ultrasonic range finding system is available from Polaroid and cost only about fourteen U.S. dollars each. Preferably, an acoustic system is provided to confirm that movement of the customer interface will not cause a collision with the vehicle.

Range finding sensors of the present invention could be, rather than ultrasonic, for example, radar or laser. Ultrasonic systems are presently preferred because they have acceptable sensitivity and are less expensive than currently available alternatives. An acceptable radar based range finding sensor has been recently developed by Lawrence Livermore Laboratories, and has been referred to as a micropower impulse radar, or MIR. This technology has been incorporated in commercial products and is both inexpensive and accurate.

The means to determine the position of the vehicle relative to the automated refuelling system may be, for example, a probe extended to an expected location of a tire, a series of pressure sensors under or in the surface on which the vehicle is located, a series of ultrasonic, radar, laser ranger finders or a vision system. The vision system is shown with a camera 110 positioned above the expected location of the vehicle looking down at the vehicle. The camera produces an image that is captured and reduced to a digital format by a frame grabbing image processing card, and communicated to a central processing unit (not shown). The central processing unit may be located in a convenient location, for example either in a building at the location of the automated refuelling system, or remotely. The vision system can determine from the data provided by the camera the location of the vehicle within the view of the camera. A vision system could also verify that the shape and, if a color camera is utilized, if the color of the vehicle matches the vehicle for which the transponder card is issued.

Automated refuelling will require that measures be taken to prevent overfilling of fuel tanks by the automated refuelling systems.

Vision and recognition cameras and software is described in, for example, U.S. Pat. Nos. 5,379,353, 5,381,155, and 5,381,489. Suitable cameras are available, and recognition algorithms useful in identifying outlines of vehicles are similar to those useful in identifying letters and symbols in documents. Edges of vehicles are identified by finding lines of changes in brightness as discussed in Patent '353. The template can be aligned and templates matched using techniques such as those discussed in Patent '489.

A preferred vision recognition system is described in U.S. patent application Ser. No. 08/462,352 filed on Jun. 5, 1995, incorporated herein by reference. This preferred system stores image templates for each vehicle make and model. When the make and model of the vehicle is determined by the radio frequency transponder data, an edge template is prepared from the appropriate stored image template. A series of modified edge templates are prepared from the edge template, each modified edge template with the vehicle in a different orientation (i.e., each turned by about two to three degrees). The series of modified edge templates and an edge image of a captured image of the vehicle adjacent to the refuelling apparatus are reduced and smoothed by averaging adjacent pixels. Each of the series of reduced modified edge templates is then compared to each location within the edge image of the captured image, with the differences quantified by, for example, a grey scale edge vector correlation. Less reduced edge image templates are then compared to less reduced edge images of the captured images to refine the location and orientation of the vehicle within the captured image. This algorithm has been found to be fast and reliable and can be accomplished using central processing units having a 386 type processing chip.

Range finding sensors of the present invention could be, rather than acoustic, for example, either radar or laser. Acoustic systems are presently preferred because they have acceptable sensitivity and are less expensive than currently available alternatives. A preferred radar range finding system has been developed by Lawrence Livermore Laboratories, and has been referred to as a micropower impulse radar, or MIR. This technology has been incorporated in commercial products and is both inexpensive and accurate.

The system of the present invention also preferably includes a collision avoidance system to ensure that the movement of the fuel dispenser does not cause it to collide with any object not expected to be in the path of the fuel dispenser. Such a system may be a radar system. Suitable radar systems are available for use with, for example, school buses, to ensure that people are not in blind spots in the path of the bus. Acoustic systems are also available and acceptable. Acoustic systems are preferred because of the general lower expense.

The system of the present invention also preferably includes a system to determine if an intruder is in the vicinity of the vehicle to be refuelled. Such a system may be an infrared motion detector, radar, acoustic, or light beams. The advantage of providing intruder detection is both to ensure that the refuelling apparatus is not tampered with while it is in operation, for the safety of people in the vehicle, and to avoid movement of the fuel dispenser colliding with the intruder.

An engine operation sensor that is preferred in the practice of the present invention is disclosed in U.S. patent application Ser. No. 08/462,279 filed on Jun. 5, 1995, incorporated herein by reference. This preferred engine operation sensor utilizes an antenna, preferably placed in concrete below the expected location of the vehicle while it is to be refuelled, that picks up an electromagnetic signal generated by an operating automobile alternator. The signal from the antenna is passed through both high frequency and low frequency filters to remove signals of frequencies greater than about 2100 Hz and less than about 700 Hz. The filtered signal is then rectified and amplified thereby converting the filtered signal from the antenna to an analog voltage that can serve as a direct input into a control system or computer. Electromagnetic signals generated from, for example, electrical motors that may operate electric windows or condenser or fan motors are filtered by this circuit, along with radio frequency transmissions. This results in a very distinctive signal that indicates a presence of an operating alternator in the vicinity of the sensor.

A preferred fuel distribution head for use with an automated refuelling method and apparatus according to the present invention is disclosed in U.S. patent application Ser. No. 08/461,281 (filed on Jun. 5, 1995), incorporated herein by reference, and a preferred apparatus for maneuvering the fuel distribution head is disclosed in U.S. patent application Ser. No. 08/461,276 filed on Jun. 5, 1995, incorporated herein by reference.

The preceding description is of a preferred embodiment, and reference is made to the following claims to determine the full scope of the present invention.

We claim:

1. A method for automatic refuelling of a vehicle comprising the steps of:

providing the vehicle with a radio frequency transponder effective to communicate information sufficient to establish a position of a fuel inlet on the vehicle;

receiving said information at the location where the vehicle is to be refuelled when the vehicle is located at the location where the vehicle is to be refuelled;

when the vehicle is located at the location where the vehicle is to be refuelled, determining the position and orientation of the vehicle within the location;

determining from the determined position and orientation of the vehicle and the communicated information, an expected location of the fuel inlet;

moving a fuel dispenser to adjacent the determined expected location of the fuel inlet;

providing a sensor on the fuel dispenser to determine the location of the fuel inlet relative to the fuel dispenser;

repositioning the fuel dispenser based on a signal from the sensor on the fuel dispensing head to a position from which the vehicle can be refuelled from the fuel dispenser; and refuelling the vehicle from the repositioned fuel dispenser.

2. The method of claim 1 wherein the transponder is a passive transponder.

3. The method of claim 1 wherein the transponder is an active transponder.

4. The method of claim 1 wherein it is determined whether or not the vehicle engine is operating by signal generated from a loop antenna that is effective to detect an electromagnetic field generated by the vehicle's alternator when the alternator is operating and the refuelling step is not started unless it is determined that the vehicle engine is not operating.

5. The method of claim 1 wherein the vehicle's position and orientation is determined by a plurality of acoustic range-finding sensors.

6. The method of claim 1 wherein the vehicle's position and orientation is determined by a digitalized visual image.

7. The method of claim 6 wherein the sensor to determine the location of the fuel inlet relative to the fuel dispenser is a camera, and a visual image from the camera is digitalized and an outline of a fuel inlet is identified from the digitalized image.

8. The method of claim 7 wherein it is determined that the vehicle engine is not operating by signal generated from a loop antenna that is effective to detect a magnetic field generated by the vehicle's alternator when the alternator is operating.

9. The method of claim 1 wherein the sensor to determine the location of the fuel inlet relative to the fuel dispenser is a magnetic flux sensor, and a magnet is fixed to the vehicle in the vicinity of the fuel inlet.

10. The method of claim 1 wherein the sensor to determine the location of the fuel inlet relative to the fuel dispenser is a camera, and a visual image from the camera is digitalized and an outline of a fuel inlet is identified from the digitalized image.

11. The method of claim 1 wherein the sensor to determine the location of the fuel inlet relative to the fuel dispenser is a transponder receiver and a transponder is fixed to the vehicle in the vicinity of the fuel inlet.

12. The method of claim 1 wherein it is determined that the vehicle engine is not operating by a sensor that detects electromagnetic waves generated by an operating vehicle's ignition.

* * * * *